US011391028B2

(12) United States Patent
Pitsch et al.

(10) Patent No.: US 11,391,028 B2
(45) Date of Patent: Jul. 19, 2022

(54) FLUSH VALVE ASSEMBLY

(71) Applicant: AS America, Inc., Piscataway, NJ (US)

(72) Inventors: Walter Pitsch, Washington, NJ (US); Marin Marinov, East Brunswick, NJ (US)

(73) Assignee: AS America, Inc., Piscataway, NJ (US)

( * ) Notice: Subject to any disclaimer, the term of this patent is extended or adjusted under 35 U.S.C. 154(b) by 0 days.

(21) Appl. No.: 17/268,832

(22) PCT Filed: Aug. 15, 2019

(86) PCT No.: PCT/US2019/046603
§ 371 (c)(1),
(2) Date: Feb. 16, 2021

(87) PCT Pub. No.: WO2020/037099
PCT Pub. Date: Feb. 20, 2020

(65) Prior Publication Data

US 2021/0189708 A1 Jun. 24, 2021

Related U.S. Application Data

(60) Provisional application No. 62/719,246, filed on Aug. 17, 2018.

(51) Int. Cl.
*E03D 1/34* (2006.01)

(52) U.S. Cl.
CPC ..... *E03D 1/34* (2013.01)

(58) Field of Classification Search
CPC ..... E03D 1/34
USPC ..... 4/413, 405, 414, 415, 416, 353
See application file for complete search history.

(56) References Cited

U.S. PATENT DOCUMENTS

| | | | |
|---|---|---|---|
| 2,153,904 | A | 4/1939 | Wilson |
| 4,327,891 | A | 5/1982 | Allen et al. |
| 2005/0087709 | A1 | 4/2005 | Nortier |
| 2006/0033060 | A1 | 2/2006 | Funari |
| 2011/0226357 | A1 | 9/2011 | Stauder et al. |
| 2013/0112905 | A1 | 5/2013 | Funari |
| 2016/0305105 | A1 | 10/2016 | Funari et al. |

OTHER PUBLICATIONS

International Search Report dated Nov. 19, 2019 in corresponding International Application No. PCT/US2019/046603 (3 pages).

*Primary Examiner* — Lori L Baker
(74) *Attorney, Agent, or Firm* — Tyler A. Stevenson; Anna-Lisa L. Gallo

(57) ABSTRACT

A flush valve assembly for use in sanitaryware, such as a toilet or urinal. A flush valve assembly may have a flush valve body that is separate from a central seating body part. A central seating body part may be attached to a flush valve body with a mounting key. Once coupled, a flush valve body and central seating body part may be permanently connected. A flush valve assembly may also include a flush valve lever assembly. A flush valve lever assembly may include a bonnet nut for securing the flush valve lever assembly to a flush valve body. A flush valve lever assembly may include an actuator pin guide having a seal for sealing between the flush valve lever assembly and a flush valve body.

17 Claims, 11 Drawing Sheets

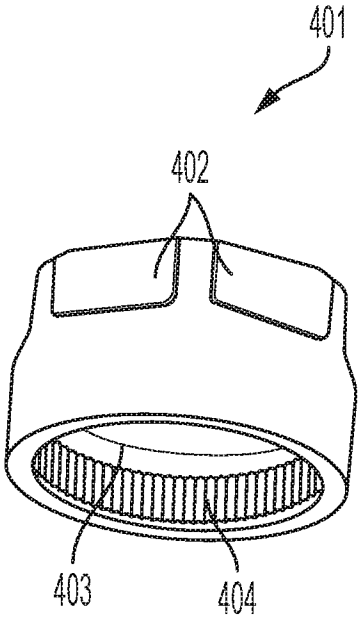
FIG. 4C
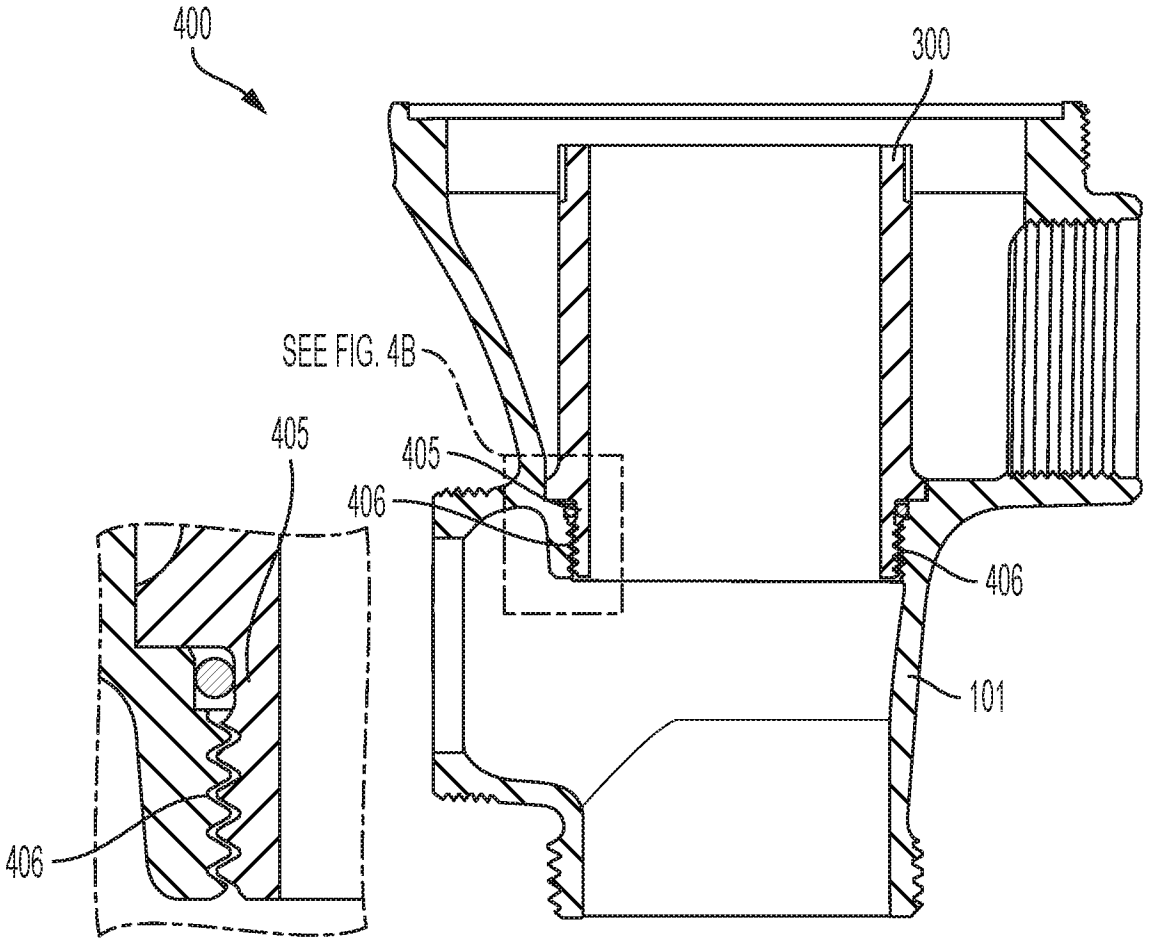
FIG. 4A
FIG. 4B

FLUSH VALVE ASSEMBLY

The present invention relates to a flush valve assembly fora toilet or urinal.

BACKGROUND

Flushometer valves (flush valves, diaphragm valves) for use with urinals and/or commercial toilets, involve integrally formed central seating body parts. Central seating body parts accommodate a valve, such as a diaphragm valve for flushing the toilet and/or urinal. To form the central seating body part integrally with the flush valve body, two sand cores are used to form the shape of the flush valve body and the shape of the central seating body part. The two sand core casting process may result in a high number and frequency of defects in the production of flush valve bodies. The defects may result in many scrapped or wasted parts. That is, the defects may produce concavities or changes in the surfaces of flush valve bodies due to porosity of the sand cores. There is a need for a reduction in scrap and waste flush valve parts due to defects. There is a need for a central seating body part that may be formed separately from the flush valve body and secured thereto after the casting process for the flush valve body.

SUMMARY

Accordingly, disclosed is a flush valve assembly, comprising a flush valve body comprising an inlet, an outlet and an opening for receiving a flush valve lever assembly; and a central seating body part configured to permanently couple within the flush valve body.

Also disclosed is a bonnet nut for a flush valve lever assembly, the bonnet nut comprising a substantially tubular body having a first end and a second end; a first threaded surface at the second end for coupling to a flush valve body; and a second threaded surface at the second end for coupling to an actuator pin guide.

According to an embodiment, a flush valve assembly may include a flush valve body; and a central seating body part configured to permanently couple within the flush valve body. The flush valve body may include an inner threaded surface for mating engagement with an outer threaded surface of the central seating body part. The central seating body part may include splines for engaging a mounting key.

According to an embodiment, the flush valve body may include an extension having an inner threaded surface, wherein the extension protrudes longitudinally toward an outlet of the flush valve body. The extension may protrude substantially perpendicularly to an opening of the flush valve body. The opening may be configured to receive a flush valve lever assembly. The flush valve lever assembly may include an actuator pin guide and a bonnet nut. The bonnet nut may be configured to threadingly engage the opening of the flush valve body and the actuator pin guide. The bonnet nut may include an interior threaded surface and an exterior threaded surface. The actuator pin guide may include an exterior threaded surface for engaging an interior threaded surface of the bonnet nut. The opening of the flush valve body may comprise an interior threaded surface for engaging an exterior threaded surface of the bonnet nut. The flush valve lever assembly may include a seal between the actuator pin guide and the opening of the flush valve body. The extension may be substantially cylindrical.

According to an embodiment, the central seating body part may include a smooth portion configured to receive an O-ring.

According to an embodiment, the central seating body part may be configured to be threaded into the flush valve body, and wherein an adhesive or glue may be provided on the central seating body part such that a connection between the central seating body part and the flush valve body is permanently connected. The connection may be a threaded connection between an outer surface of the central seating body part and an inner surface of the flush valve body.

According to an embodiment, the flush valve body may include a shoulder, and wherein the central seating body part has a flange adjacent the shoulder. A body part flange may be configured to rest on and/or mate with a flush valve body shoulder. The flush valve may include an O-ring between the flush valve body and the flange.

According to an embodiment, the flush valve body may comprise brass and the central seating body part may comprise plastic. A plastic may be a thermoplastic, for instance a polyamide, a styrenic polymer, polyester, polyolefin, polycarbonate, mixtures thereof, copolymers thereof, and the like.

According to an embodiment, a bonnet nut for a flush valve lever assembly may include a substantially tubular body having a first end and a second end; a first threaded surface at the second end for coupling to a flush valve body; and a second threaded surface at the second end for coupling to an actuator pin guide. The first threaded surface may be an outer threaded surface and the second threaded surface may be an inner threaded surface. The bonnet nut may include a plurality of flat portions configured to receive a tool. The bonnet nut may include a flange, the flange having a surface configured to engage a surface of a flush valve body. The substantially tubular body may be configured to receive a flush valve lever assembly. The first end may include a rounded portion configured to receive a radial bearing. The first end may include a surface configured to engage a surface of the actuator pin guide.

According to an embodiment, a method for assembling a flush valve may include providing a flush valve body, the flush valve body having a connection member; permanently coupling a central seating body part to the connection member; and coupling a flush valve lever assembly to an opening of the flush valve body. The method may include inserting a diaphragm valve into the central seating body part; and securing a flush valve cap to the flush valve body. The connection member may be an extension comprising a threaded surface. Coupling the central seating body part to the connection member may include threading the central seating body part to the connection member. The method may include engaging splines on a mounting key with splines on the central seating body part; and rotating the mounting key to rotate the central seating body part. The method may include applying adhesive to a threaded surface of the central seating body part; and rotating the mounting key to engage the threaded surface of the central seating body part with a threaded surface of the flush valve body. The method may include permanently coupling the central seating body part to the flush valve body with adhesive. The method may include installing a seal on the central body seating part prior to coupling the central seating body part to the connection member. Coupling the flush valve lever assembly to the opening of the flush valve body may include threading a bonnet nut to an actuator pin guide; and subsequently threading the bonnet nut to the opening of the flush valve body. The method may include installing a seal on the actuator pin guide prior to threading the bonnet nut to the opening of the flush valve body.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements. The accompanying drawings are included to provide a further understanding of the invention and are incorporated in and constitute a part of this specification.

FIG. 4*a* is a cross-section view of a flush valve assembly comprising a flush valve body having a central seating body part in an interior thereof, according to an embodiment.

FIG. 4*b* shows an enlarged view of a connection between the flush valve body and central seating body part of FIG. 4*a*, according to an embodiment.

FIG. 4*c* is a perspective view of a mounting key for a central seating body part, according to an embodiment.

DETAILED DESCRIPTION

In an embodiment, disclosed is a flush valve body having a central seating body part formed separate from the casting of a flush valve body. The central seating body part may be coupled to the flush valve body after the flush valve body has been cast. The central seating body part may have a threaded surface which interacts with a threaded surface on a flush valve body. A central seating body part may be permanently coupled or secured to a flush valve body during assembly. In an embodiment, also disclosed is a flush valve lever assembly for a flush valve. A flush valve lever assembly may include a bonnet nut and actuator pin guide for securing to a flush valve body. A flush valve lever assembly may eliminate the need for a separate mounting nut or mounting feature and may result in an enhanced seal between a flush valve lever assembly and a flush valve body.

Figure 1:
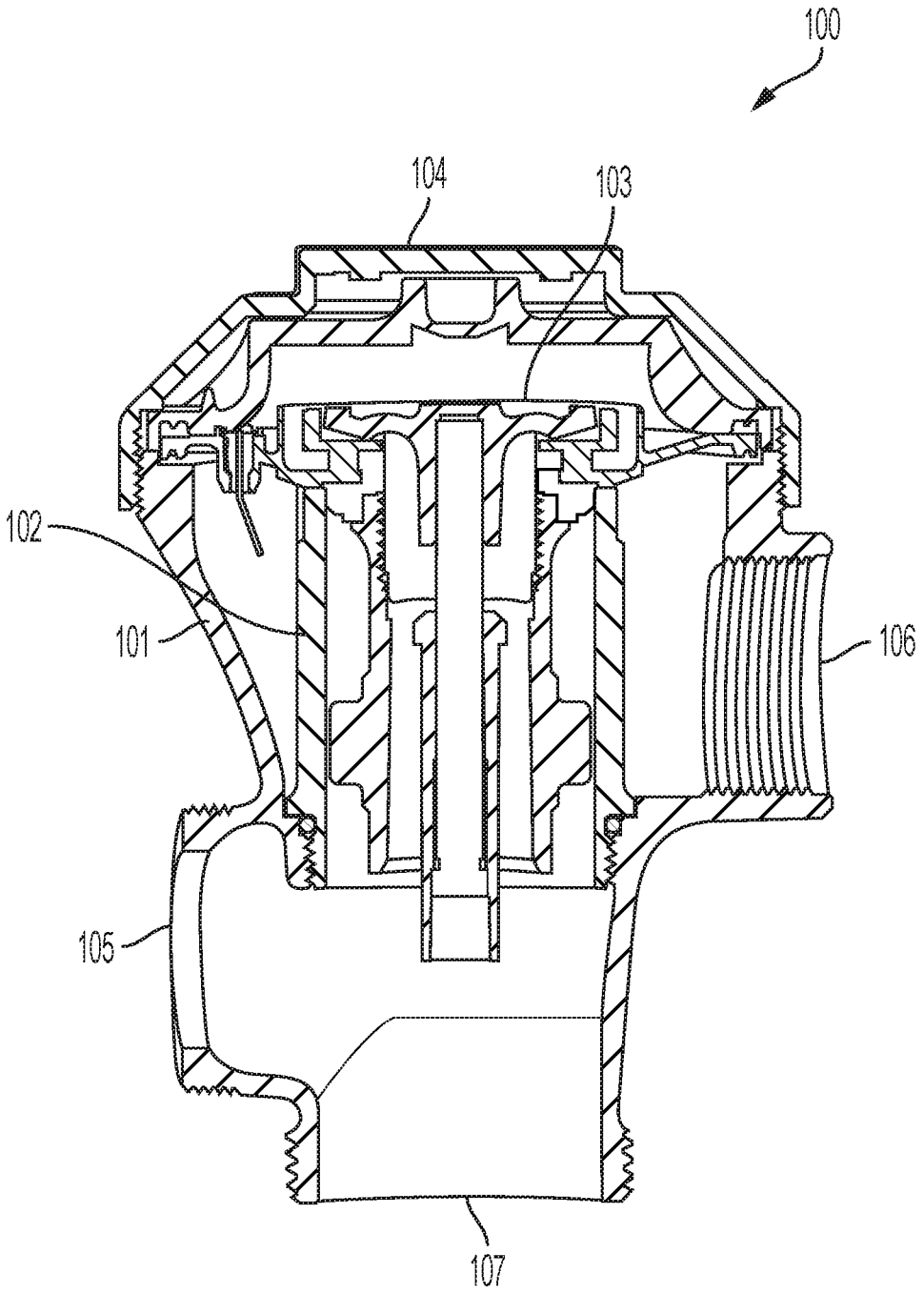
FIG. 1 is a cross-section view of a flush valve assembly, according to an embodiment.

FIG. 1 is a cross-section view of flush valve assembly 100, according to an embodiment. Flush valve assembly 100 may include a flush valve body 101, a central seating body part 102, a valve 103, and a flush valve cap 104. Central seating body part 102 may be secured within flush valve body 101 as will be described in more detail to follow. Central seating body part 102 may be a valve seat for the valve 103. Valve 103 may be a diaphragm valve. Valve 103 may be seated within central seating body part 102 for actuation with a flush valve lever assembly. A flush valve lever assembly may be coupled to an opening 105 in flush valve body 101. Flush valve cap 104 may be secured to flush valve body 101. Flush valve 100 includes a flush valve inlet 106 and a flush valve outlet 107.

FIGS. 2*a*-2*g* show views of flush valve body 101. Flush valve body 101 contains a central open space or bore 201. Flush valve body 101 includes opening 105, flush valve inlet 106, and flush valve outlet 107. Opening 105 may have a threaded surface 202 for receiving a housing, such as a bonnet nut (not depicted), for a flush valve lever assembly. Threaded surface 202 may be an outer threaded surface. Flush valve inlet 106 may have a threaded surface 203 for coupling to a pipe or pipe connection for coupling flush valve body 101 to a main water supply. Threaded surface 203 may be an inner threaded surface. Flush valve outlet 107 may have a threaded surface 204 for coupling directly to a toilet or urinal or for coupling to a connection (e.g. a pipe) to a toilet or urinal. Threaded surface 204 may be an outer threaded surface. Flush valve body 101 may include an upper opening 205. Upper opening 205 may allow for installation or insertion of a valve. Upper opening 205 may have a threaded surface 206 for coupling to a flush valve cap. Threaded surface 206 may be an outer threaded surface. Although threaded surface 203 is depicted and described as an inner threaded surface, an outer threaded surface may be provided. Similarly, although threaded surfaces 202, 204, and 206 are depicted and described as outer threaded surfaces, an inner threaded surface may be provided.

Figure 2A:
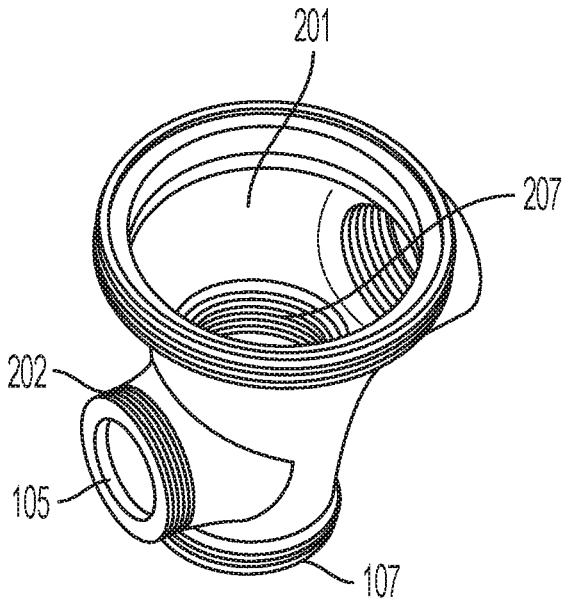
FIG. 2*a* shows a perspective view of a flush valve body, according to an embodiment.
Figure 2B:
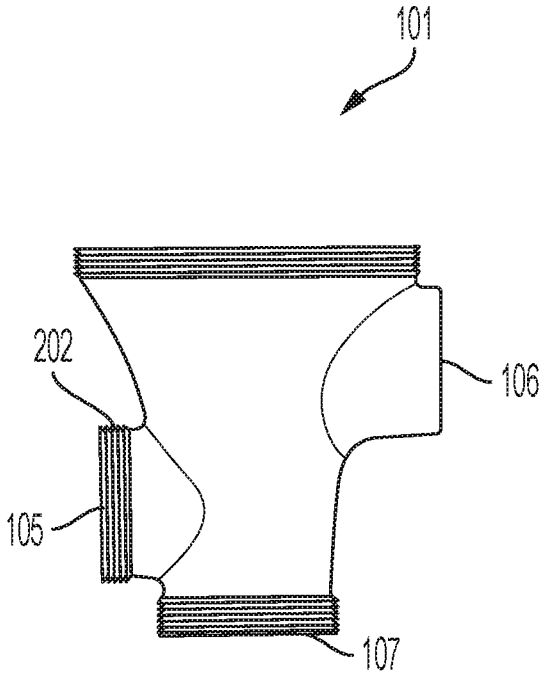
FIG. 2*b* shows a side view of a flush valve body, according to an embodiment.
Figure 2C:
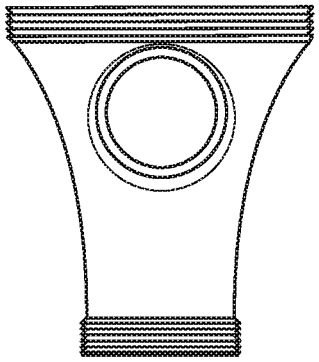
FIG. 2*c* shows side view of a flush valve body, rotated about 90 degrees from FIG. 2*b*, according to an embodiment.
Figure 2D:
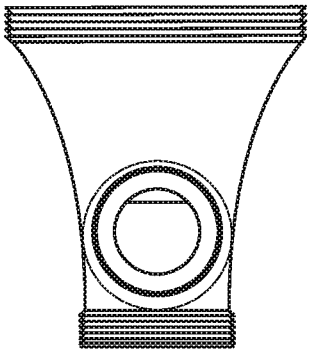
FIG. 2*d* shows side view of a flush valve body, rotated about 180 degrees from FIG. 2*c*, according to an embodiment.
Figure 2E:
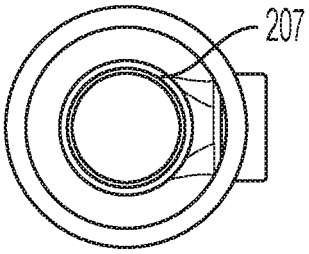
FIG. 2*e* shows a top view of a flush valve body, according to an embodiment.
Figure 2F:
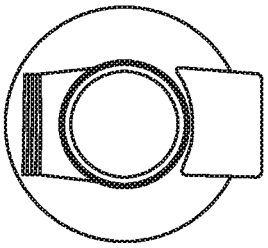
FIG. 2*f* shows a bottom view of a flush valve body, according to an embodiment.
Figure 2G:
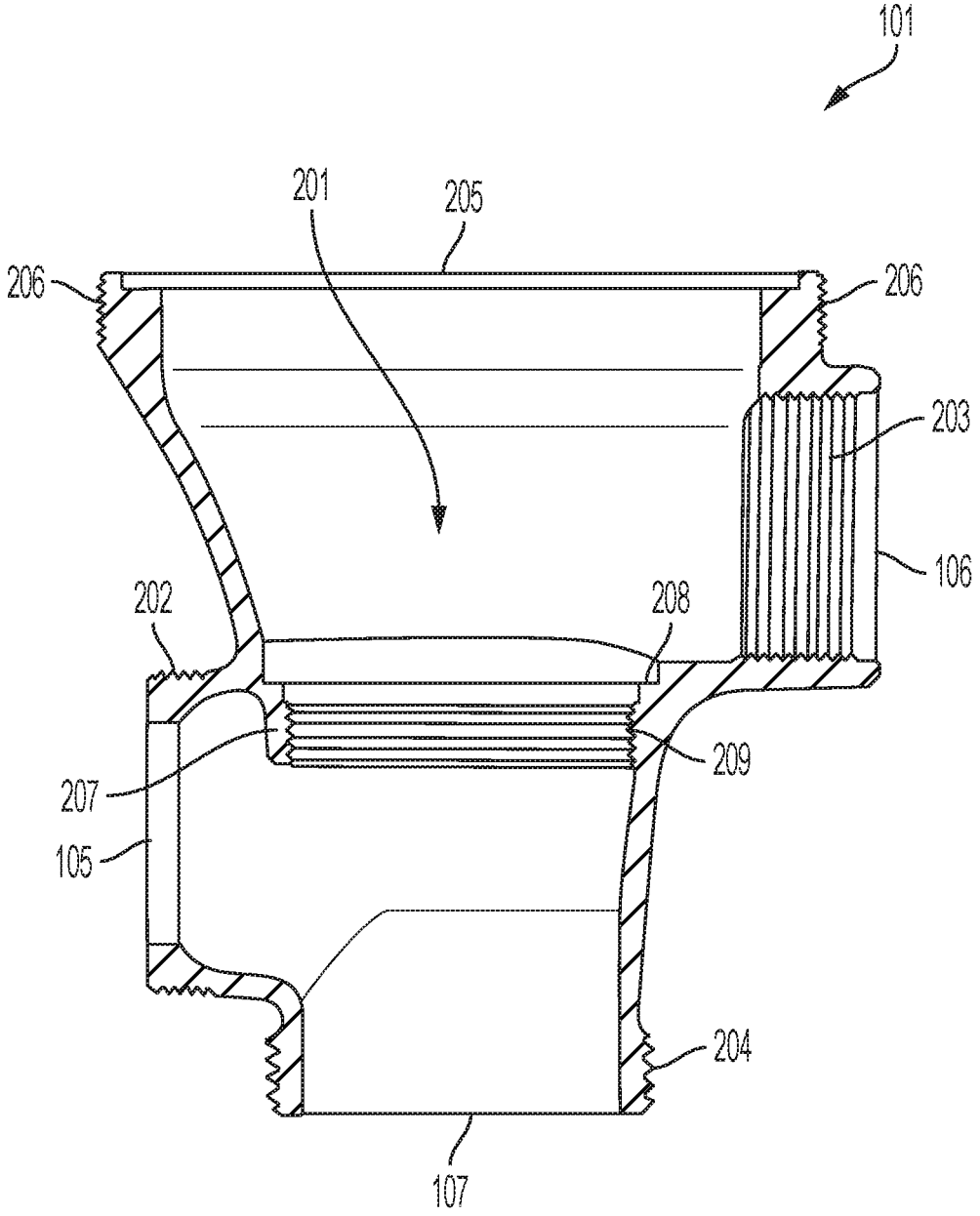
FIG. 2*g* shows a cross-section view of a flush valve body, according to an embodiment.

Flush valve body 101 may include an extension 207. Extension 207 may be a connection member for coupling flush valve body 101 to the central seating body part. Extension 207 may protrude longitudinally within flush valve body 101. Extension 207 may protrude longitudinally toward a flush valve outlet 107. As can be seen in FIG. 2*a* and FIG. 2*e*, extension 207 may be substantially cylindrical. Extension 207 may have an upper surface 208. Upper surface 208 may form a ledge or shoulder within flush valve body 101. Extension 207 may have an inner threaded surface 209. Inner threaded surface 209 may be configured to couple to a central seating body part.

Figure 3A:
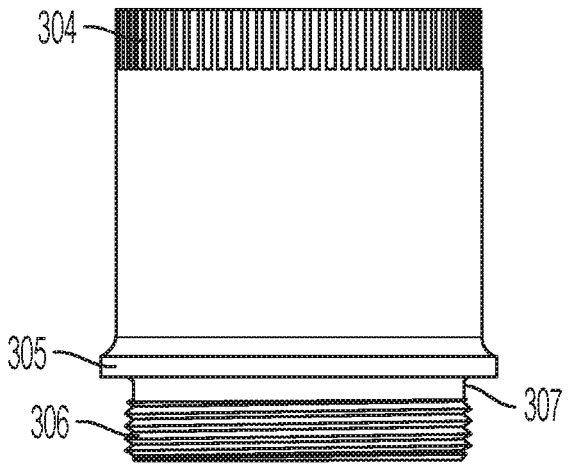
FIG. 3*a* shows a side view of a central seating body part for a flush valve assembly, according to an embodiment.
Figure 3B:
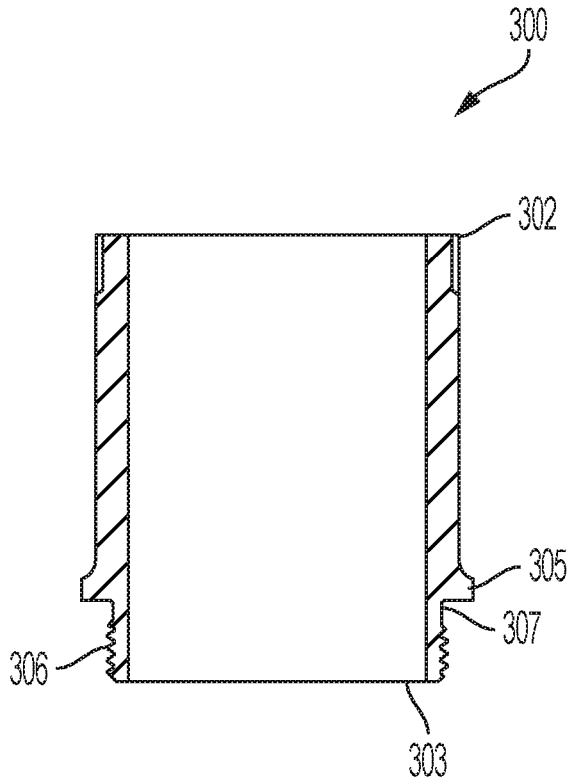
FIG. 3*b* shows a cross-section view of a central seating body part, according to an embodiment.
Figure 3C:
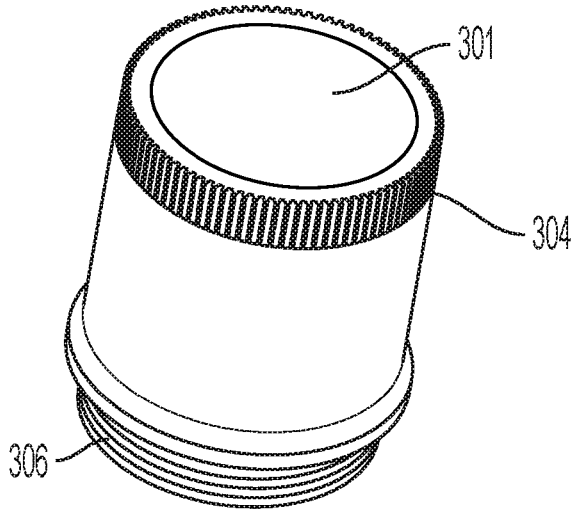
FIG. 3*c* shows a perspective view of a central seating body part, according to an embodiment.
Figure 5A:
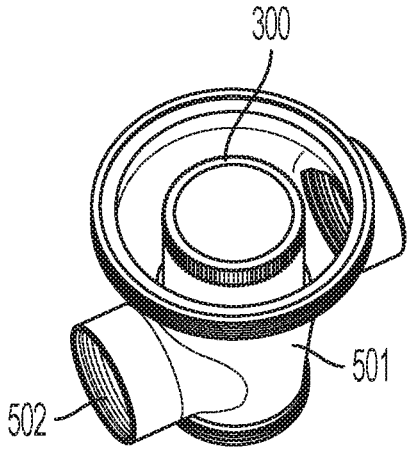
FIG. 5*a* shows a perspective view of a flush valve assembly comprising a flush valve body with a central seating body part disposed therein, according to an embodiment.
Figure 5B:
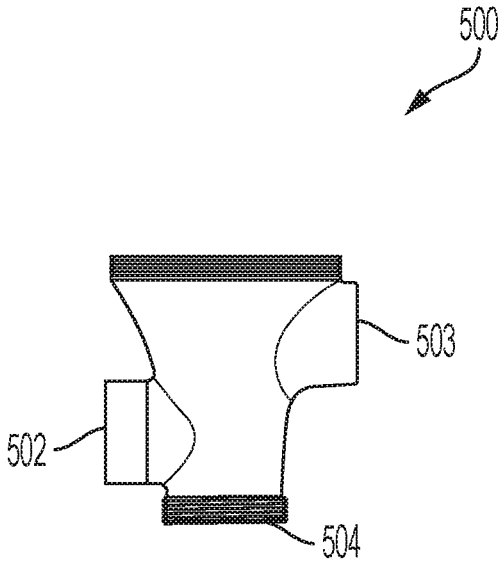
FIG. 5*b* shows a side view of a flush valve assembly, according to an embodiment.
Figure 5C:
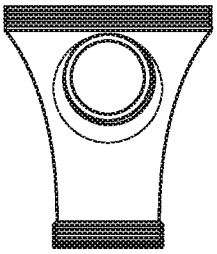
FIG. 5*c* shows a side view of a flush valve assembly, rotated about 90 degrees from FIG. 5*b*, according to an embodiment.
Figure 5D:
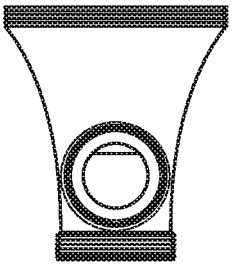
FIG. 5*d* shows a side view of a flush valve assembly, rotated about 180 degrees from FIG. 5*c*, according to an embodiment.
Figure 5E:
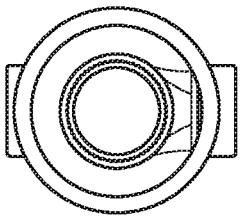
FIG. 5*e* shows a top view of a flush valve assembly, according to an embodiment.
Figure 5F:
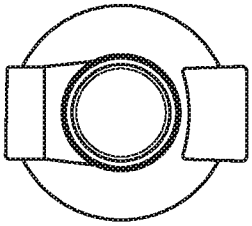
FIG. 5*f* shows a bottom view of a flush valve assembly, according to an embodiment.
Figure 5G:
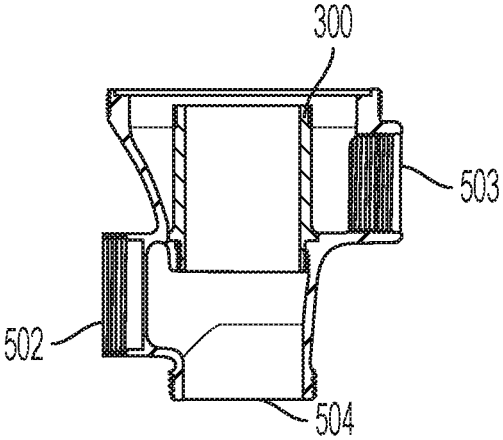
FIG. 5*g* shows a cross-section view of a flush valve assembly comprising a flush valve body having a central seating body part disposed therein, according to an embodiment.

FIG. 3*a*, FIG. 3*b*, and FIG. 3*c* show view of a central seating body part 300. Central seating body part 300 may be substantially cylindrical. Central seating body part 300 includes a bore 301 extending from an upper surface 302 to a lower surface 303. Bore 301 may accommodate a valve, such as valve 103 of FIG. 1. Central seating body part 300 may include one or more splines 304 in an outer surface thereof. One or more splines 304 may be a plurality of splines. One or more splines 304 may extend longitudinally downward from upper surface 302. One or more splines 304 may be a series of protrusions and recesses or ridges and grooves. One or more splines 304 may be configured to mate or correspond to one or more splines on a mounting key (FIG. 4*c*).

Central seating body part 300 may have a flange 305. Central seating body part 300 may include a threaded surface 306. Threaded surface 306 may be an outer threaded surface. Threaded surface 306 may extend longitudinally below the flange 305. Threaded surface 306 may couple to or engage with an inner threaded surface 209 of flush valve body 101. A smooth portion 307 may be provided between flange 305 and a top of threaded surface 306. Smooth portion 307 may be configured to accommodate an O-ring.

FIG. 4*c* shows mounting key 401, which may be provided to install a central seating body part within a flush valve body. Mounting key 401 may be a cap. Mounting key 401 may include one or more flat portions 402 to receive a wrench (not depicted) or other tool. Mounting key 401 may have a bore 403 to receive at least a portion of a central seating body part during installation. Mounting key 401 may have one or more splines 404. One or more splines 404 may mate with or correspond to one or more splines on a central seating body part (FIG. 3*a*, FIG. 3*c*). In this manner, when mounting key 401 is rotated, the corresponding mated splines will cause rotation of a central seating body part.

FIG. 4*a* shows a flush valve assembly 400 comprising a flush valve body having a central seating body part in an interior thereof, according to an embodiment. FIG. 4*b* is an enlarged view of the circled portion of FIG. 4*a*. Flush valve assembly 400 contains central seating body part 300 disposed within flush valve body 101. Upon assembly, an O-ring 405 may be placed on a smooth portion 307 of central seating body part 300. O-ring 405 may be any sealing member, such as a gasket or metal seal. Central seating body part 300 may be lowered into the flush valve body 101 with threaded surface 306 entering the bore 201 first. Central seating body part 300 may be threaded into flush valve body 101. Threading may occur by coupling threaded surface 306 of central seating body part 300 with inner threaded surface 209 of flush valve body 101. To achieve threading, mounting key 401 may be installed on a top of central seating body part 300. One or more splines 404 may be aligned with one or more splines 304 on central seating body part 300. Although splines are depicted and described, any mating surface that permits a mounting key to transfer rotational movement to a central seating body part may be provided. Mounting key 401 may be rotated (e.g. such as with a wrench on the flat portions 402). Rotation of mounting key 401 may translate to rotation of central seating body part 300. As mounting key 401 and central seating body part 300 rotate, threaded surface 306 may engage inner threaded surface 209. Mounting key 401 and central seating body part 300 may be rotated until flange 305 of central seating body part 300 contacts extension 207 of flush valve body 101. When installed, O-ring 405 may be located within a space between an inner wall of flush valve body 101 and smooth portion 307, and above threaded portion 406. O-ring 405 may provide a seal within flush valve body 101.

A flush valve body of the present disclosure may achieve an easier casting process due to removal of a central seating body part from the casting process. In an embodiment, casting of flush valve body 101 no longer includes casting of a central seating body part 300. This may reduce the number of defects in a single flush valve body and may reduce the frequency of defects in a production line of flush valve bodies. Reduction in defects may reduce the reduction in waste due to discarding of flush valve bodies that are unusable due to the number, size, shape, etc. of defects. This saves cost due to a reduction in waste or scrapped parts and a reduction in tooling. A single sand core may be used to form a flush valve body. Where a central seating body part is integral to a flush valve body as in FIG. 6*b*, two sand cores are required. A reduction in tooling (e.g. due to the reduction in sand cores) may reduce the cost of materials, tooling, and cost associated with increased production time.

A central seating body part may be formed of a hard, stable material capable of withstanding the high pressures experienced during a flush cycle. In an embodiment, the material may be at least about 50 percent glass filled silica. A central seating body part may be formed via injection molding. A central seating body part may have a hardened surface after molding. A central seating body part may be permanently installed in a flush valve body during the production phase of a flush valve assembly. A central seating body part may be assembled with adhesive on a threaded surface 306. An adhesive may permanently secure a central seating body part within an extension 207 of a flush valve body 101. A central seating body part may be permanently coupled to a flush valve body on the production line such that the relationship between a valve 103 and a central seating body part is consistent between all flush valves 100 produced on the assembly line.

In an embodiment, FIGS. 5*a*-5*g* depict a flush valve assembly 500 comprising a flush valve body 501 and central seating body part 300. Opening 502 contains an inner threaded surface for coupling to a flush valve lever assembly. Also shown are inlet 503 and outlet 504.

Figure 6B:
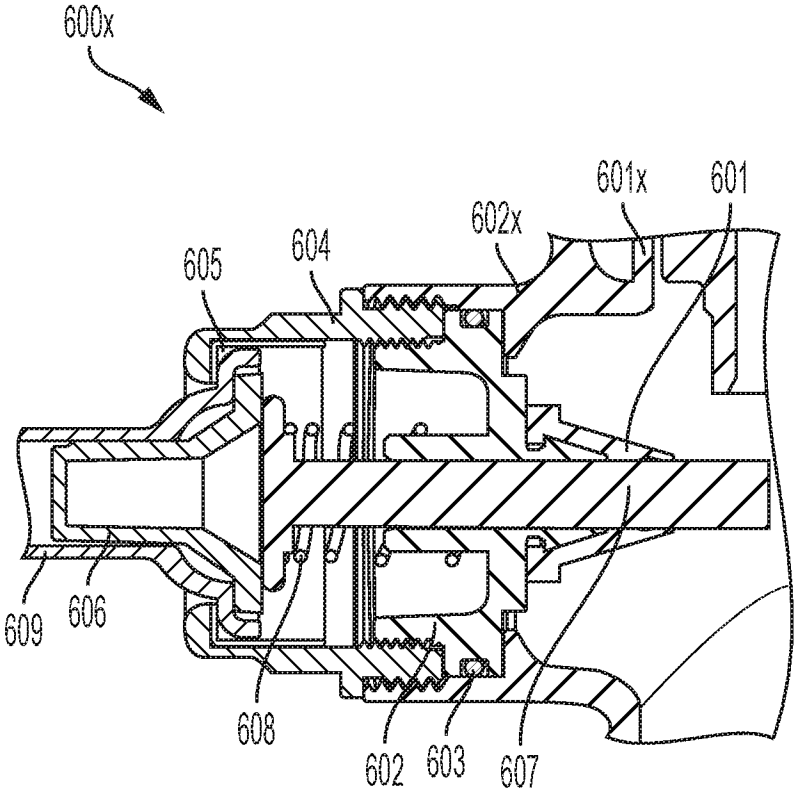
FIG. 6*b* shows a partial cross-section view of a flush valve lever assembly coupled to a flush valve body, according to an embodiment.
Figure 6A:
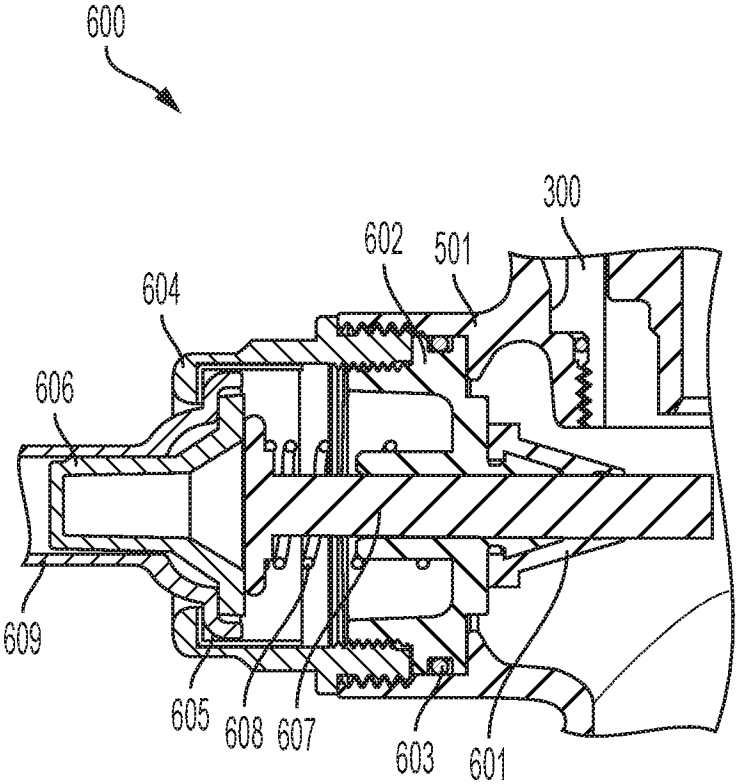
FIG. 6*a* depicts a partial cross-section view of a flush valve lever assembly coupled to a flush valve body, according to an embodiment.

FIG. 6*a* and FIG. 6*b* show partial side cross-section views of a flush valve lever assembly 600 and 600*x*, respectively. Flush valve lever assembly 600 provides a view of a flush valve lever assembly coupled to flush valve assembly 500 of FIGS. 5*a*-5*g*. Alternatively, flush valve lever assembly 600*x* provides a view of a flush valve lever assembly coupled to a central seated body part 601*x* integrally formed with a flush valve body 602*x*. A flush valve lever assembly may include a nozzle 601, an actuator pin guide 602, a seal 603, a bonnet nut 604, a radial bearing 605, an axial bearing 606, an actuator pin 607, a biasing member 608, and a lever 609. Biasing member 608 may be a spring, such as, for example, a coil spring. Seal 603 may be an O-ring. Seal 603 may be ethylene propylene diene monomer rubber (EPDM) or other rubber or rubber-like material.

Figure 7A:
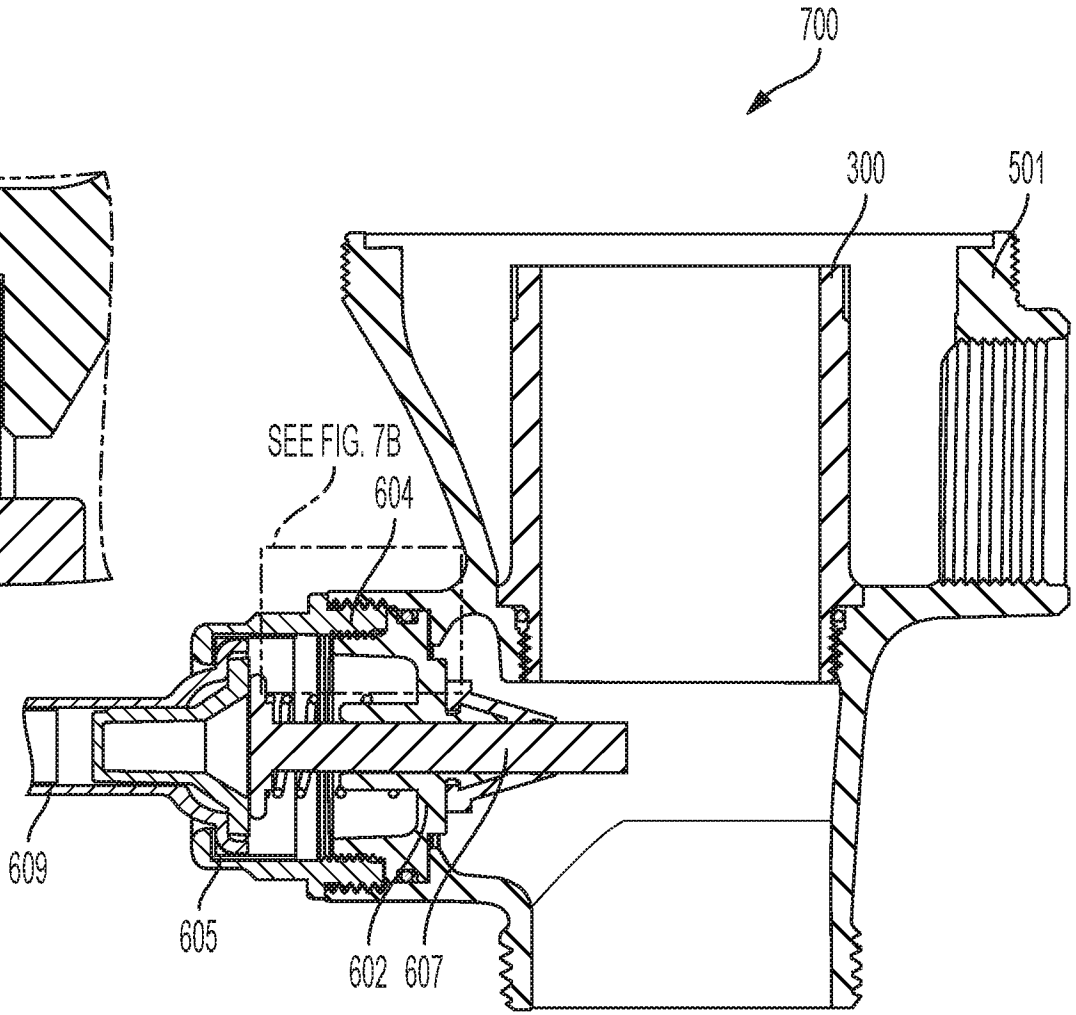
FIG. 7*a* shows a cross-section view of a flush valve assembly, according to an embodiment.
Figure 7B:
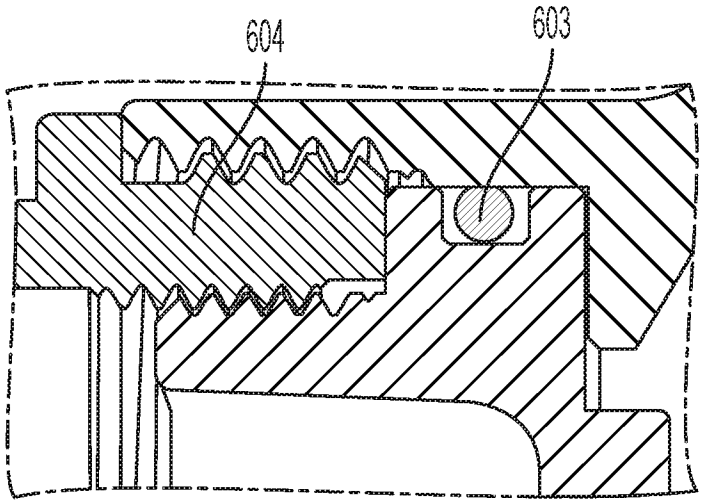
FIG. 7*b* depicts an enlarged view of a connection of a flush valve body and a flush valve lever assembly of FIG. 7*a*, according to an embodiment.

FIG. 7*a* shows a cross-section view of flush valve assembly 700, according to an embodiment. Flush valve body 501 contains central seating body part 300 disposed therein. Flush valve body 501 is coupled to flush valve lever assembly 600. Visible are actuator pin 607, lever 609, actuator pin guide 602, and bonnet nut 604. Bonnet nut 604 secures actuator pin guide 602 via threaded connections. Bonnet nut 604 may receive radial bearing 605 and lever 609. FIG. 7*b* provides an enlarged view of the connection circled in FIG. 7*a*.

Figure 8:
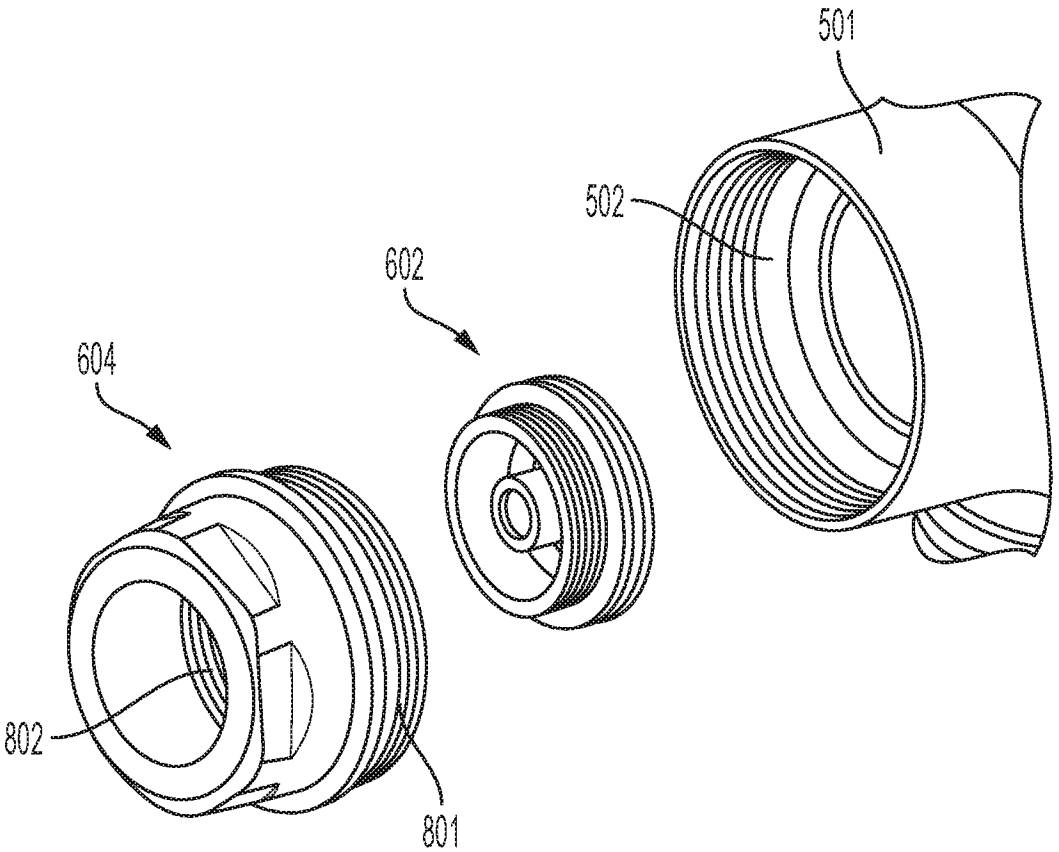
FIG. 8 shows an exploded view of components of a flush valve lever assembly.
Figure 9A:
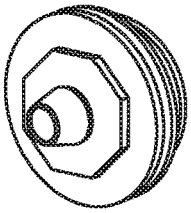
FIG. 9*a* and FIG. 9*b* show perspective views of an actuator pin guide, according to an embodiment.
Figure 9B:
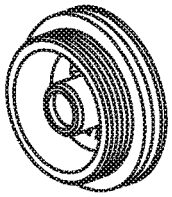
Figure 9C:
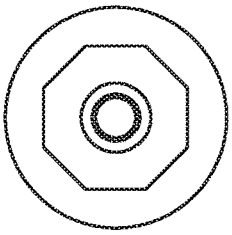
FIG. 9*c* shows a top view of an actuator pin guide, according to an embodiment.
Figure 9D:
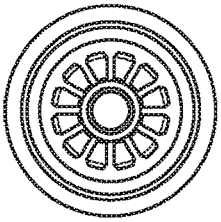
FIG. 9*d* shows a bottom view of an actuator pin guide, according to an embodiment.
Figure 9E:
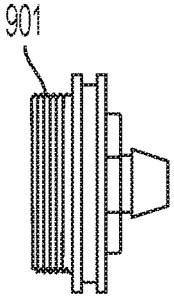
FIG. 9*e* and FIG. 9*f* show side views of an actuator pin guide, at about 180 degree rotation intervals, according to an embodiment.
Figure 9F:
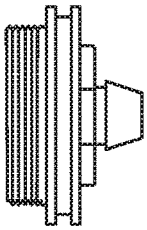
Figure 9G:
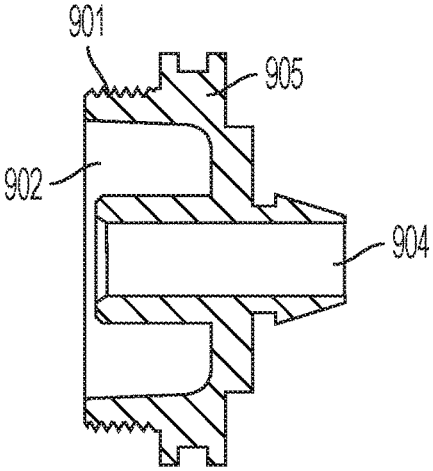
FIG. 9*g* and FIG. 9*h* show cross-section views of an actuator pin guide, according to an embodiment.
Figure 9H:
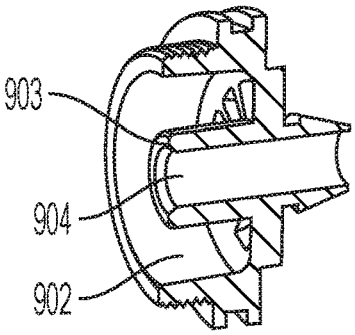
Figure 10A:
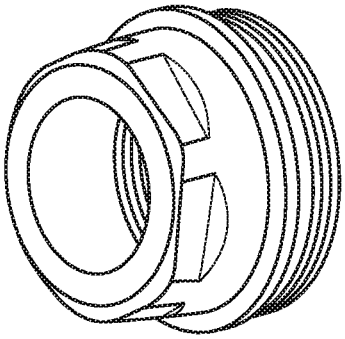
FIG. 10*a* and FIG. 10*b* show a perspective views of a bonnet nut, according to an embodiment.
Figure 10B:
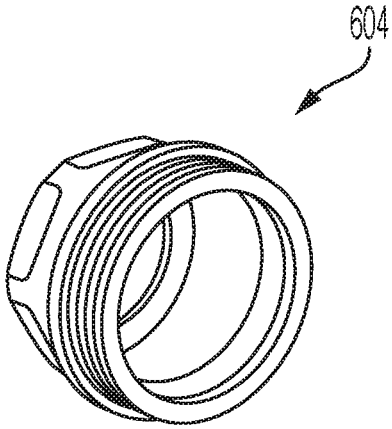
Figure 10C:
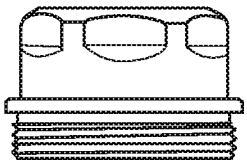
FIG. 10*c*, FIG. 10*d*, and FIG. 10*e* show side views of a bonnet nut, at about 90 degree rotation intervals, according to an embodiment.
Figure 10D:
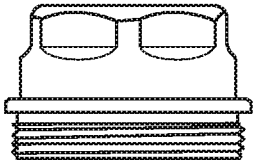
Figure 10E:
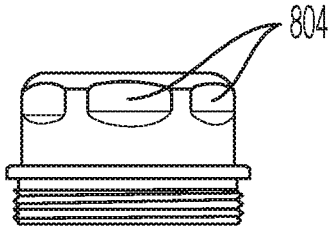
Figure 10F:
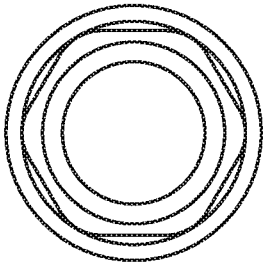
FIG. 10*f* shows a top view of a bonnet nut, according to an embodiment.
Figure 10G:
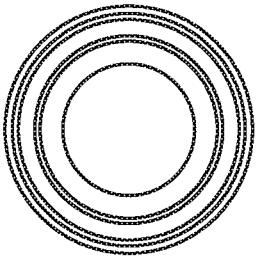
FIG. 10*g* shows a bottom view of a bonnet nut, according to an embodiment.
Figure 10H:
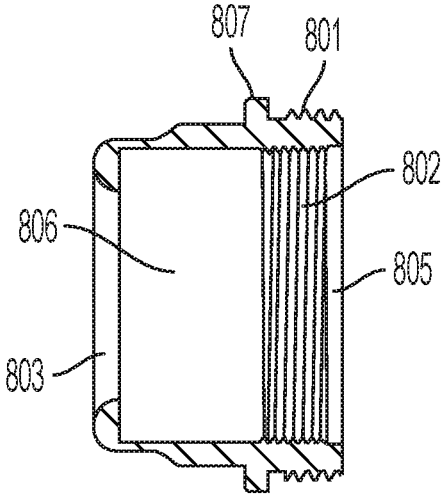
FIG. 10*h* is a cross-section view of a bonnet nut, according to an embodiment.

FIG. 8 provides an exploded view of a portion of flush valve body 501, opening 502, actuator pin guide 602, and bonnet nut 604, according to an embodiment. Opening 502 contains an inner threaded surface. An opening 502 inner threaded surface may mate with an outer threaded surface 801 on bonnet nut 604. Bonnet nut 604 may contain an inner threaded surface 802.

FIGS. 9*a*-9*h* provide views of actuator pin guide 602, according to an embodiment. Pin guide 602 may have an outer threaded surface 901. Threaded surface 901 may be configured to mate with threaded surface 802 of bonnet nut 604. Pin guide 602 comprises bore 902. The bore 902 may receive biasing member 608 (FIG. 6*a*). Actuator pin guide 602 may include an extension 903. Extension 903 may include a bore 904 configured to receive actuator pin 607. Pin guide 602 may include a flange 905 including a groove as shown. A flange groove may receive an O-ring 603 as shown in FIG. 6*a*. Actuator pin guide 602 may be secured between a surface of a bonnet nut and a surface of an opening of a flush valve body. Seal 603 may provide a seal between an outside of a flush valve body and an inside of a flush valve body. An actuator pin guide may be formed of a thermoplastic. In some embodiments, an actuator pin guide may be formed via injection molding.

FIGS. 10*a*-10*h* provide various views of bonnet nut 604. A bonnet nut may be substantially cylindrical. Bonnet nut 604 comprises a first end 803 configured to receive radial bearing 605. First end 803 may comprise flat portions 804 configured for interacting with a tool, such as a wrench. A second end 805 comprises an inner threaded surface 802 and an outer threaded surface 801. Outer threaded surface 801 is configured for mating with an inner threaded surface of a flush valve body opening.

Bonnet nut 604 comprises a bore 806 configured to receive components of a flush valve lever assembly. Bore 806 may receive an actuator pin guide, an actuator pin, a biasing member, a radial bearing, an axial bearing, and a lever. Bore 806 includes inner threaded surface 802, configured to mate with a threaded surface of actuator pin guide 602. Bonnet nut 604 may include a flange 807. Flange 807 may be configured for engaging or nearing a surface of a flush valve body. A bonnet nut may be formed of brass and may be chrome plated. A bonnet nut may be machined, such as, for example, on a lathe.

During assembly, components of a flush valve lever assembly may be aligned within a flush valve body opening and a bonnet nut may be turned (e.g. with a tool on the flat portions thereof) to secure the flush valve lever assembly to the flush valve body. A bonnet nut may be rotated until a surface, for instance a flange, is adjacent, touches, or is near to a surface of the flush valve body. A bonnet nut may include an inner threaded surface configured to mate with an outer threaded surface on an actuator pin guide. During assembly, a bonnet nut may be secured to an actuator pin guide via a threaded connection of a bonnet nut inner threaded surface and a pin guide outer threaded surface. A bonnet nut may be threaded to an actuator pin guide prior to securing an outer threaded surface of the bonnet nut to an inner threaded surface of a flush valve opening.

In some embodiments, a flush valve lever assembly of the present disclosure may eliminate the use of a mounting nut when coupling a flush valve lever assembly to a flush valve body. A flush valve lever assembly may be secured to a flush valve body with a single nut, the bonnet nut. Elimination of a mounting feature allows for a universal mount nut. This may save materials and cost. This may achieve enhanced sealing between the flush valve body and the flush valve lever assembly (e.g. due to the inclusion of a seal in the actuator pin guide).

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through. The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

All U.S. patent applications, published patent applications and patents referred to herein are hereby incorporated by reference.

Although the foregoing description is directed to certain embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A flush valve assembly, comprising a flush valve body comprising an inner surface, an outer surface, a flush valve inlet, a flush valve outlet, and an opening for receiving a flush valve lever assembly; and a central seating body part comprising an outer surface and a bore configured to accommodate a valve, wherein the central seating body part outer surface is permanently connected to the flush valve body inner surface.

2. The flush valve assembly of claim 1, comprising a flush valve lever assembly comprising an actuator pin guide and a bonnet nut.

3. The flush valve assembly of claim 2, wherein the bonnet nut comprises an interior threaded surface and an exterior threaded surface and is configured to threadingly engage the opening of the flush valve body and the actuator pin guide.

4. The flush valve assembly of claim 3, wherein the actuator pin guide comprises an exterior threaded surface for engaging the interior threaded surface of the bonnet nut, and wherein the opening of the flush valve body comprises an interior threaded surface for engaging the exterior threaded surface of the bonnet nut.

5. The flush valve assembly of claim 2, wherein the flush valve lever assembly comprises a seal between the actuator pin guide and the opening of the flush valve body.

6. The flush valve assembly of claim 1, wherein the flush valve body comprises an inner threaded surface for mating engagement with an outer threaded surface of the central seating body part.

7. The flush valve assembly of claim 1, wherein the central seating body part comprises splines for engaging a mounting key.

8. The flush valve assembly of claim 1, wherein the flush valve body comprises an extension having an inner threaded surface, and wherein the extension protrudes longitudinally toward the outlet of the flush valve body.

9. The flush valve assembly of claim 8, wherein the extension is substantially cylindrical.

10. The flush valve assembly of claim 1, wherein the central seating body part comprises a smooth portion configured to receive an O-ring.

11. The flush valve assembly of claim 1, wherein the central seating body part is configured to be threaded into the flush valve body, and wherein adhesive is provided on the central seating body part such that the central seating body part and the flush valve body are permanently connected.

12. The flush valve assembly of claim 1, wherein the flush valve body includes a shoulder, and wherein the central seating body part has a flange adjacent the shoulder.

13. The flush valve of claim 1, comprising an O-ring between the flush valve body and the central seating body part.

14. The flush valve assembly of claim 1, wherein the flush valve body comprises brass and the central seating body part comprises plastic.

15. A bonnet nut for a flush valve lever assembly, the bonnet nut comprising a substantially tubular body having a first end and a second end;

a first threaded surface at the second end for coupling to a flush valve body; and a second threaded surface at the second end for coupling to an actuator pin guide, wherein the first threaded surface is an outer threaded surface and the second threaded surface is an inner threaded surface, and the bonnet nut comprises a flange configured to engage a surface of a flush valve body.

16. The bonnet nut of claim 15, wherein the first end further comprises a rounded portion configured to receive a radial bearing.

17. The bonnet nut of claim 15, wherein the bonnet nut comprises brass and the actuator pin guide comprises a thermoplastic.

* * * * *